US005419236A

United States Patent [19]

Plettner

[11] Patent Number: 5,419,236

[45] Date of Patent: May 30, 1995

[54] METHOD FOR CONTROLLING A HYDRAULIC DRIVE AND CONFIGURATION FOR CARRYING OUT THE METHOD

[75] Inventor: Horst Plettner, Hanau, Germany

[73] Assignee: ABB Patent GmbH, Mannheim, Germany

[21] Appl. No.: 110,081

[22] Filed: Aug. 20, 1993

[30] Foreign Application Priority Data

Aug. 20, 1992 [DE] Germany ..... 42 27 562.8

[51] Int. Cl.[6] ..... F15B 15/17

[52] U.S. Cl. ..... 91/416; 91/442; 91/451

[58] Field of Search ..... 91/5, 416, 417 R, 442, 91/451, 452; 60/406, 413

[56] References Cited

U.S. PATENT DOCUMENTS 3,969,985 7/1976 Grieger et al. ..... 91/417 R
4,226,166 10/1980 Frank ..... 60/413

FOREIGN PATENT DOCUMENTS 2835063 2/1980 Germany ..... 91/417 R
3447132 7/1986 Germany .
3612827 10/1987 Germany .
3616914 11/1987 Germany .
3915107 11/1990 Germany .
9111861 11/1991 Germany .
884647 12/1961 United Kingdom ..... 91/417 R

*Primary Examiner*—F. Daniel Lopez
*Attorney, Agent, or Firm*—Herbert L. Lerner; Laurence A. Greenberg

[57] ABSTRACT

In a method and a configuration for operating a hydraulic drive, a 3/2-port directional seat valve, which is driven by solenoid coils, controls an application of high-pressure fluid through a working piston of a piston/cylinder system. In order to increase the circuit-breaking capacity of the working piston, a hydraulic booster valve which is driven hydraulically by the 3/2-port directional seat valve is used for clearing a direct path from the piston/cylinder system to the low-pressure reservoir during switching-off.

3 Claims, 1 Drawing Sheet

METHOD FOR CONTROLLING A HYDRAULIC DRIVE AND CONFIGURATION FOR CARRYING OUT THE METHOD

BACKGROUND OF THE INVENTION

FIELD OF THE INVENTION

The invention relates to a method for controlling a hydraulic drive for an electrical power circuit breaker and a configuration for carrying out the method.

As is known, such a drive is disclosed in Publication No. DESAN 1008 92 D dated March 1992 of the firm ABB Schaltanlagen GmbH.

If it is desired to increase the circuit-breaking capacity of the electrical circuit breaker, a correspondingly higher mechanical circuit-breaking power must be provided by the drive of such a device. Two methods are essentially available to make the existing drive capable of that operation. Thus, operating the drive with an increased pressure difference of the working fluid could be considered, but that requires a material outlay which is no longer acceptable.

On the other hand, larger valve cross sections could be chosen, in particular, in order to allow more working fluid to flow out of the piston/cylinder system per unit time during circuit breaking. That necessitates more powerful circuit-breaking solenoid coils which are not obtainable commercially. The provision of a second, parallel valve seat, which would have to be capable of being driven by a further solenoid valve, would therefore be conceivable. Since the circuit-breaking solenoids are always kept available in duplicate form for safety reasons, that solution implies an increase in cost which is not insignificant. Added thereto are increased outlays for electrical conductors and control devices, and the provision of a correspondingly larger battery power.

SUMMARY OF THE INVENTION

It is accordingly an object of the invention to provide a method for controlling a hydraulic drive and a configuration for carrying out the method, which overcome the hereinaforementioned disadvantages of the heretofore-known methods and devices of this general type and which increase the circuit-breaking power of the hydraulic drive effectively with an acceptable outlay, while maintaining the working pressure.

With the foregoing and other objects in view there is provided, in accordance with the invention, a method and a configuration for controlling a hydraulic drive for an electrical circuit breaker, in particular a high-voltage power circuit breaker, including a piston/cylinder system with a piston rod, and a working piston being displaced for circuit-breaker actuation and having a base side being piston rod-free; a high-pressure reservoir, a low-pressure reservoir; a bistable 3/2-port directional seat valve connecting the base side to either the high-pressure reservoir or the low-pressure reservoir; and solenoid coils actuating the 3/2-port directional seat valve; which comprises triggering a hydraulic booster valve with the 3/2-port directional seat valve to provide a direct path from the base side of the working piston to the low-pressure reservoir for circuit-breaking operation.

Therefore, according to the invention, the hydraulic booster valve, which is hydraulically driven by the 3/2-port directional seat valve as a result of a circuit-breaking command, releases a sufficiently large cross section for draining the working fluid from the piston/-cylinder system into the low-pressure reservoir.

The stored hydraulic power which is released during circuit breaking by the 3/2-port directional seat valve acting as a reversing valve, is utilized solely to drive the hydraulic booster valve. The booster valve can be used in any desired size (throughput quantity), and specifically without having to enlarge the 3/2-port directional seat valve.

In accordance with another feature of the invention, the booster valve is formed by a piston which can be displaced in a housing and which serves both as valve closure device and as a valve control device. In this case, one piston side includes a forepiston which is provided with sealing seats, that effects the valve closure and which has a piston surface that faces the piston/cylinder system. The other piston side serves solely for valve control and a load is applied to it or removed from it by pressure fluid. Due to the forepiston, the "flying" piston of the booster valve acts, in the closed position, as differential piston, in which the control piston surface is opposite the forepiston side that is substantially smaller than the latter.

In accordance with a further feature of the invention, the control connection of the booster valve is connected to the seat-free connection of the 3/2-port directional seat valve on one hand, and a connection of the booster valve is connected to the piston/cylinder system on the other hand. Connected in parallel with these connections is a line which incorporates a check or non-return valve that blocks or cuts off flow in the direction of the 3/2-port directional seat valve. In particular, during the circuit breaking, the non-return or check valve ensures that the load is immediately removed from the control connection of the booster valve and the booster valve is able to open without delay.

In accordance with an added feature of the invention, there is provided a restriction connected in parallel with the non-return or check valve, for ensuring in the switch-off position that linkages draining away through the working piston of the piston/cylinder system are removed to the low-pressure reservoir through the 3/2-port seat valve and no unintentional "creeping" switching-on of the working piston takes place.

In accordance with a concomitant feature of the invention, there is provided a return spring continuously loading the control piston side of the booster valve. Therefore, the booster valve is able to immediately close again after completion of a circuit-breaking operation. This already sets it to the safe operating position which is necessary for the switching-on operation. Malfunctions are consequently reliably eliminated.

Other features which are considered as characteristic for the invention are set forth in the appended claims.

Although the invention is illustrated and described herein as embodied in a method for controlling a hydraulic drive and configuration for carrying out the method, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWINGS

FIG. 2 is the operating circuit diagram with the circuit breaker being switched on.

DESCRIPTIONS OF THE PREFERRED EMBODIMENTS

Figure 1:
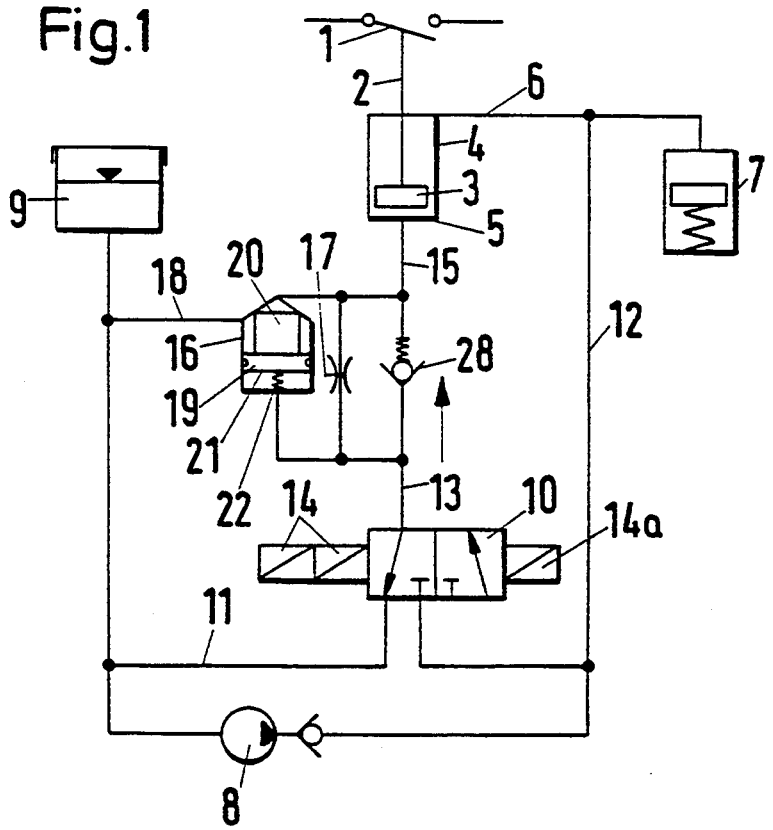
FIG. 1 is an operating schematic circuit diagram with an electrical circuit breaker being switched off.

Referring now to the figures of the drawing in detail and first, particularly, to FIG. 1 thereof, there is seen an electrical switch or circuit breaker 1, preferably a high-voltage power circuit breaker, which is mechanically coupled through a piston rod 2 to a working piston 3 of a piston/cylinder system 4. The working piston 3 acts as differential piston. On one hand, the working piston 3 has a piston-rod-free base side 5 (larger piston surface) having a load applied to it or removed from it by high-pressure fluid for the purpose of switching-on and switching-off. On the other hand, a smaller piston surface on the piston-rod side is continuously connected to a high-pressure reservoir 7 through a line 6. If necessary, working fluid is pumped from a low-pressure reservoir 9 into the high-pressure reservoir by means of a pump 8.

Figure 2:
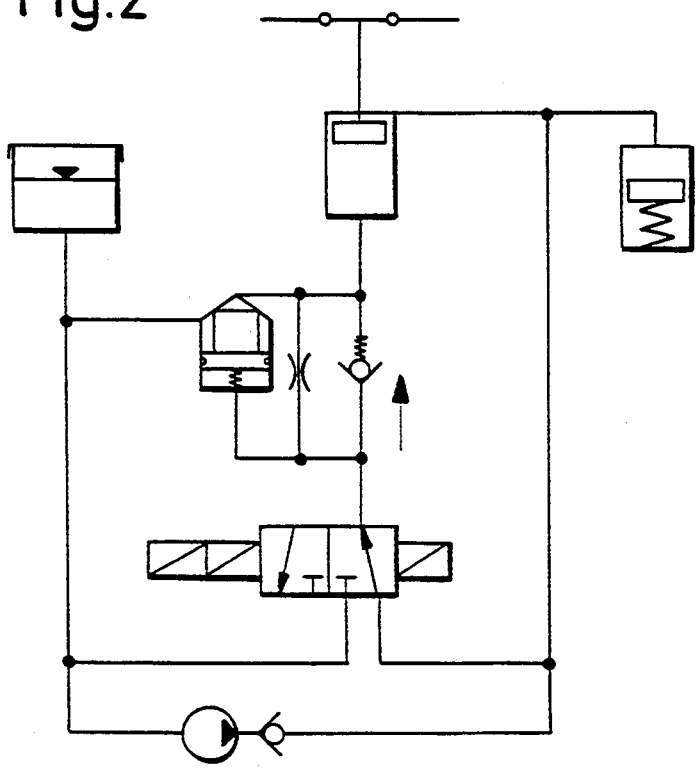

As its description already suggests, a 3/2-port directional seat valve 10 includes a total of three connections, two of which have valve seats. The connections equipped with valve seats can be connected over a line 11 to the low-pressure reservoir 9 and over a line 12 to the high-pressure reservoir 7. As a result, upon actuating the 3/2-port directional seat valve, the valve-seat-free connection, which is connected to a line 13, is optionally connected to the high-pressure reservoir 7 as is seen in FIG. 2, or to the low-pressure reservoir 9, as is seen in FIG. 1. The 3/2-port directional seat valve 10 is actuated by means of solenoid coils, and specifically by a trip or solenoid coil 14 for the circuit-breaking actuation and a further trip or solenoid coil **14*a* for switching-on. The solenoid coil 14** is present in duplicate for redundancy reasons.

A connecting line 15 of the piston/cylinder system faces the base side 5 of the working piston 3. The valve-seat-free connection of the 3/2-port directional valve 10 is connected to the connecting line 15 through a parallel circuit. The parallel circuit is made up of a booster valve 16, a restriction 17 and a non-return or check valve 28. The valve function of the booster valve 16 includes making a connection between the connecting line 15 and a line 18 leading to the low-pressure reservoir 9, if necessary. In other words, the booster valve 16 clears a direct path from the base side 5 of the working piston to the low-pressure reservoir. The booster valve 16 essentially includes a "flying" piston 19, which can be displaced in a housing. One side of the piston 19 has a further forepiston 20 that forms a valve closure device. The other side of the piston 19 forms a control piston side 21, which is connected to the 3/2-port directional seat valve. A return spring 22 constantly presses the piston 19 into the illustrated closed position of the booster valve 16.

The mode of operation of the device is as follows:

In the switched-off position of the circuit breaker 1 shown in FIG. 1, the load is removed from the base side 5 of the working piston 3 and it is connected to the low-pressure reservoir 9 through the connecting line 15, the diaphragm 17, the line 13, the 3/2-port directional seat valve 10 and the line 11.

If the solenoid coil **14*a* is given a switch-on command, the 3/2-port directional seat valve switches over to the position shown in FIG. 2. The line 13 is then connected to the line 12 leading to the high-pressure reservoir 7. High-pressure fluid can then flow through the non-return or check valve 28 in the direction of the arrow, directly onto the base side 5 of the working piston 3 and the latter will move into the switched-on position shown in FIG. 2. At the same time high-pressure fluid will flow through the line 13 onto the control piston side 21 of the booster valve 16, as a result of which the piston 19 will securely hold the booster valve in the closed position because of its differential piston surfaces which are then operational. The differential action results from the sufficiently different surfaces, namely of the forepiston 20 on one hand, and the control piston side 21 on the other hand. The sealing seats of the forepiston 20 securely separate the connecting line 15 from the line 18**.

If a switch-off command is then given to the solenoid coil 14, the 3/2-port directional seat valve switches over to the position shown in FIG. 1 and the line 13 is connected to the low-pressure reservoir 9. The load can consequently be immediately removed from the control piston side 21 of the booster valve, and the relatively high pressure which still loads the forepiston 20 and is fed from the piston/cylinder system 4 moves the piston 19 against the return spring 22. The forepiston 20 leaves its sealing seat and consequently the piston surface still present in addition to the forepiston 20 also becomes operational, and this further accelerates the piston 19 into its valve open position. A large passage for the fluid from the connecting line 15 to the line 18 and, consequently, to the low-pressure reservoir 9, is rapidly made. The load is removed in turn from the working piston 3 through its base side 5 and the piston moves into the switched-off position. Drainage of the fluid is not possible through the non-return or check valve 28 which cuts off flow against the direction of the arrow, while its passage through the restriction 17, which is always open, is negligible. After the switched-off position of the working piston 3 has been reached, the return spring 22 closes the booster valve 16 again. Leakage losses through the working piston 3 are removed through the restriction 17, as a result of which a stable final position of the system is established.

I claim:

1. A configuration for controlling a hydraulic drive for an electrical circuit breaker, comprising:

a piston/cylinder system including a piston rod, and a working piston being displaced for circuit-breaker actuation and having a base side being piston rod-free;

a high-pressure reservoir, a low-pressure reservoir;

a bistable 3/2-port directional seat valve selectively connecting said base side to said high-pressure reservoir and said low-pressure reservoir;

solenoid coils actuating said 3/2-port directional seat valve;

a hydraulic booster valve being triggered by said 3/2-port directional seat valve to provide a direct path from said base side of said working piston to said low-pressure reservoir for circuit-breaking operation;

a valve connection of said booster valve being continuously connected to said piston/cylinder system;

a control connection of said booster valve being continuously connected to said 3/2-port directional seat valve;

a check valve being connected in parallel with said booster valve and control connections for blocking flow in the direction of said 3/2 port directional seat valve; and p1 a restriction for shunting said check valve connected in parallel with said booster valve and said check valve.

2. The configuration according to claim 1, wherein said booster valve includes a piston being displaced in a housing and serving both as a valve closure devise and a valve control devise, and said piston of said booster valve has a piston side with a forepiston effecting valve closure and having sealing seats and a piston surface always being in communication with said piston/cylinder system.

3. The configuration according to claim 2, wherein said booster valve includes a return spring continuously acting on said valve closure device in a closing position direction.

* * * * *